US005792012A

United States Patent [19]

Dudley

[11] Patent Number: 5,792,012

[45] Date of Patent: Aug. 11, 1998

[54] STREET HOCKEY PUCK

[76] Inventor: Peter B. Dudley, 16359 Shady View La., Los Gatos, Calif. 95032

[21] Appl. No.: 862,595

[22] Filed: May 23, 1997

[51] Int. Cl.[6] ..... A63B 71/02

[52] U.S. Cl. ..... 473/588

[58] Field of Search ..... 473/588, 587, 473/589, 229, 230, 231

[56] References Cited

U.S. PATENT DOCUMENTS 5,269,520 12/1993 Vellines ..... 473/588
5,518,238 5/1996 Hu et al. ..... 473/588 X
5,531,442 7/1996 Gill ..... 473/588
5,568,923 10/1996 Kahn et al. ..... 473/588

*Primary Examiner*—Raleigh W. Chiu

[57] ABSTRACT

A hockey puck for use on unsmooth surfaces such as streets and parking lots consisting of two generally equal sized halves. Sandwiched between the two halves is an energy absorbing member or members. Springs or foam washers can serve as these members. The two halves are loosely connected together so that only one will receive the direct impact from striking a imperfection in the street or other playing surface. The energy absorbing members dampen the forces transferred between the two puck halves. This results in a puck which can travel across rough surfaces with a greatly reduced likelihood of tumbling or bouncing.

15 Claims, 8 Drawing Sheets

STREET HOCKEY PUCK

FIELD OF THE INVENTION

This invention relates to hockey pucks used on non-ice surfaces. In particular, the invention relates to street hockey pucks which are generally designed for use on flat semi-smooth to rough surfaces.

BACKGROUND TO THE INVENTION

The most readily available non-ice surfaces for playing hockey are asphalt and concrete. They are the streets, parking lots and outdoor play areas at schools and parks. Because of the traffic and weathering, these surfaces are generally semi-smooth to rough. Hockey pucks designed for play on smooth surfaces perform very erratically on these surfaces. There have been many relatively recent attempts to design a puck that would work on these surfaces. Many of these recently patented pucks have not yet become commercially available. Several may prove to be too costly to manufacture and sell.

An example of such a puck is described in U.S. Pat. Nos. 5,568,923 Kanh et al. (1996). The preferred embodiment of this invention consists of 89 individual parts including 30 rollers. Obviously many of these parts would be designed out when it is manufactured. But, the basic design of the puck requires the use of many rollers, and making and assembling them will be costly. Probably too costly to be able to sell to the price sensitive market of school aged children.

Like Kanh et al., many pucks have used wheels or spheres to improve puck performance on rough surfaces. An example of another patented puck which utilizes many wheels is U. S. Pat. Nos. 5,518,238 Hu et al. (1996). The various embodiments disclosed in this patent utilize from eight to thirty wheels or from five to eighteen spherical rollers. The probable cost of manufacturing some of these embodiments may equal the cost of manufacturing the Kanh et al. puck. Not every patented puck, that utilizes rolling members, include as many as do these two. Several use just three spheres. Three such pucks are U.S. Pat. Nos. 4,793,769 Dolan (1988), 4,801,144 De Masi, Jr. et al. (1989), and 5,531,442 Gill (1996). While clearly these three would not be as expensive to manufacture, they do share a problem common to all pucks with revolving parts. The problem is the bearing surfaces are vulnerable to dirt and grit.

The asphalt and concrete surfaces have dirt, dust, sand and sometimes water on them. These things will get into the bearings or bearing surfaces of these types of pucks. The wheels and spheres will soon stop rolling and will not provide the function that they were designed to do. Spheres are particularly prone to failure. First there is no mechanical advantage to the sphere bearing. It is dependent on there being less friction between the sphere and its adjacent cavity, than between the sphere and the playing surface. As it is being used, dirt and grit will get between the sphere and the cavity. The sphere will also become scratched and gouged by stones embedded in the playing surface. The spheres will stop turning freely and will not help the puck travel smoothly over the playing surface. The dirt and dust will generally soon render pucks with revolving parts no better than pucks that were solid to begin with.

Solid pucks are not costly to manufacture, and that may explain why they seem to be the most commonly sold. Solid pucks also perform very badly on semi-smooth or rough surfaces. On such surfaces the solid puck will not travel far before it bounces, tumbles or starts rolling. They are easily upset by playing surface imperfections while being shot, passed or even just being pushed along with a hockey stick. Stick handling, moving the puck side to side with the stick, is impossible since the solid puck will not stay flat on the playing surface. A typical solid puck is disclosed in U.S. Pat. No. 5,275,410 Bellehumeur et al. (1994). Like most, it is the about the same size and shape as an ice hockey puck. The main body is made up of an elastic material and embedded in this material are runners. The runners project out of the body and are made from materials with low friction and good wear characteristics.

The intended function of the projecting runners is to reduce friction. Their unintended function is to get caught in the many imperfections found in the playing surfaces. In concrete they cause the puck to trip on cracks and expansion joints. In asphalt the imperfections are usually holes which the projecting runners can easily fall into and upset the puck. On a surface like a nicely finished tennis court these solid pucks perform fine. On the typical surface available to most kids, most solid pucks are nearly unusable.

SUMMARY OF THE INVENTION

The puck of this invention is essentially the same shape as an ice hockey puck. It can be made the same size as an ice hockey puck, three inches in diameter by one inch high, and it will perform very well. Improved performance can be obtained by slightly increasing the diameter to 3.2 inches and slightly reducing the height to 0.9 inches. The puck consists of two generally cylindrical shaped halves. In some embodiments the two halves are identical. In the remaining embodiments the differences are primarily involved with different methods of fastening the two halves together.

The two members are loosely connected together so that the two cylindrical halves are coaxial. Semi-tubular rivets or similar means can be used to connect the two halves of the puck together. When assembled the two halves are separated by a small distance, approximately an eighth of an inch. Held in the space between the two halves are energy absorbing foam or springs. As the puck slides across a rough surface it will encounter many imperfections. When the bottom half strikes the imperfection its course is altered upward. As it moves upward it will compress the spring or foam above it. The spring or foam absorbs the sudden shock of hitting the imperfection. The result is a softer collision with imperfections. If the imperfection is large enough, then the puck will lift off of the playing surface. When the puck lands back upon the playing surface the springs or foam help absorb the force of the landing. The springs or foam dampen every contact the puck has with the surface, which greatly reduces the incidents of bouncing, tumbling and rolling.

Therefore, it is an object of the present invention to provide a puck that will rarely bounce, tumble, or roll when used on asphalt, concrete or other unsmooth surfaces.

Because it slides in a controlled predictable manner, a further object is to provide a puck that can be stick handled on unsmooth surfaces.

A large proportion of puck purchases are by children, so a third object is to provide a puck that can be affordably priced and durable.

A fourth object is to provide a puck that when shot or passed will travel along a straight predictable path.

These and other objects and advantages of the present invention, will no doubt become obvious to those of ordinary skill in the art, after having read the following detailed description of the embodiments, which are illustrated in the various drawing figures.

DETAILED DESCRIPTION

Figure 1:
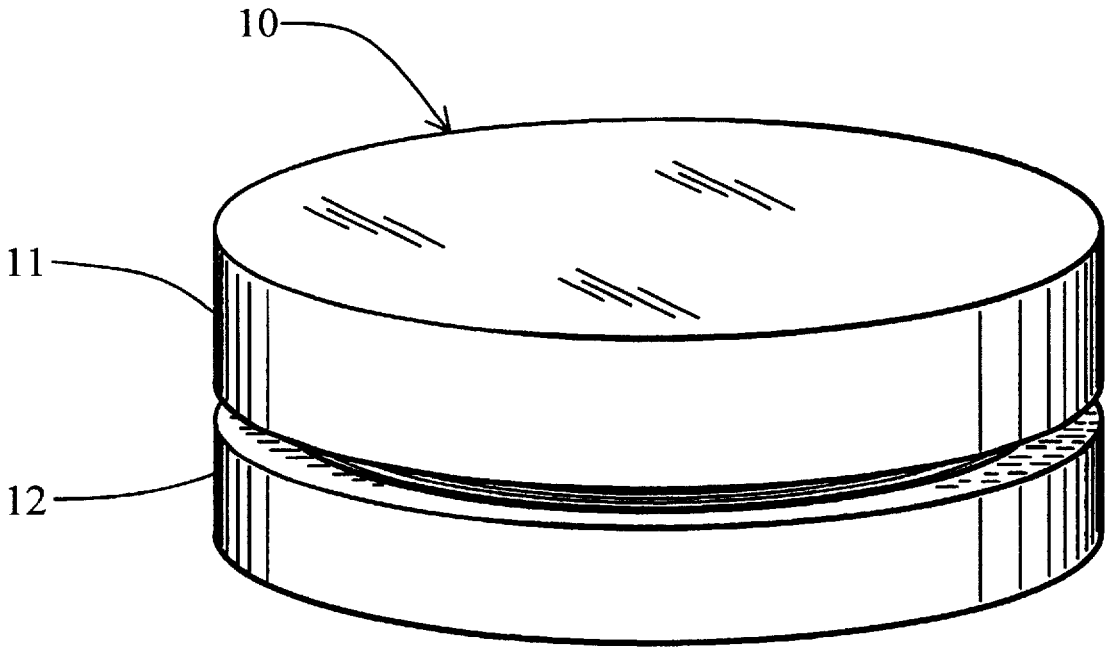
FIG. 1 is a perspective view of the first embodiment of the street hockey puck.
Figure 2:
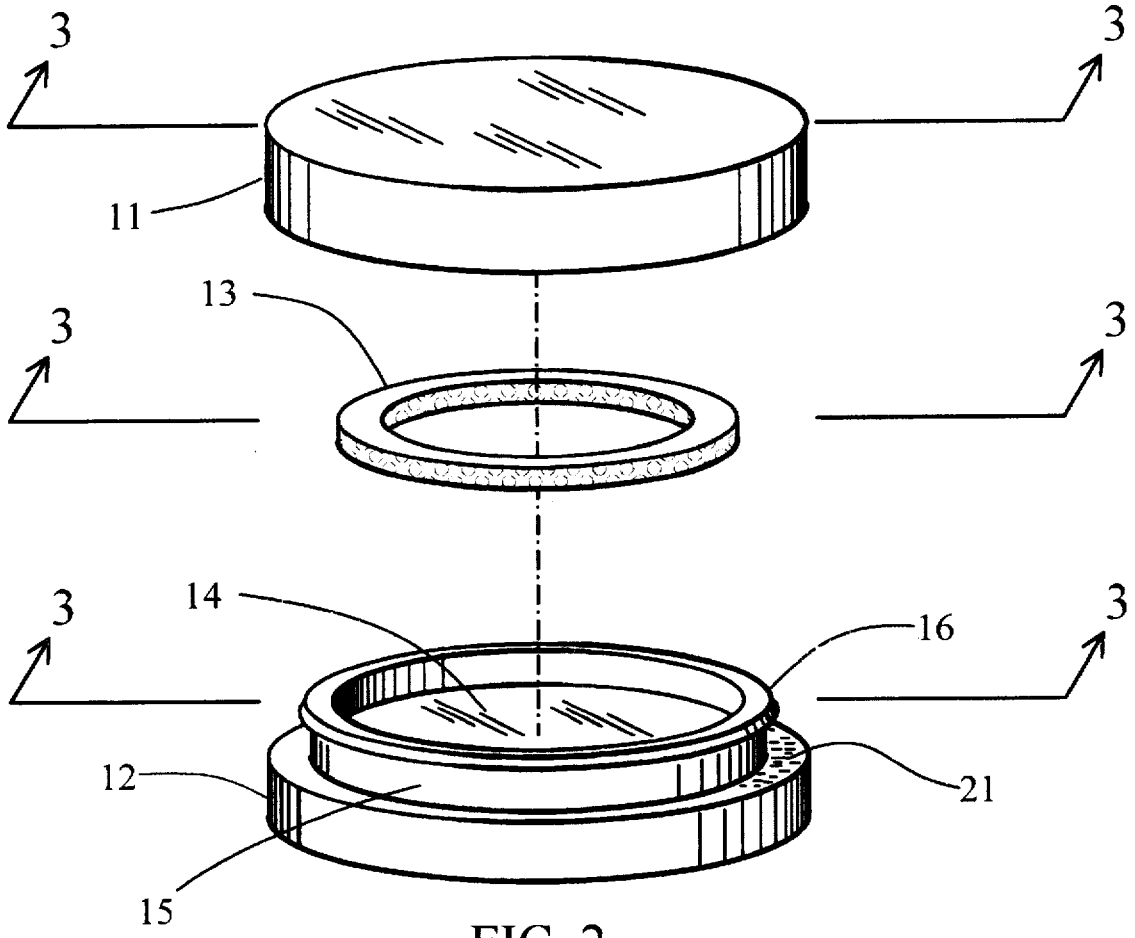
FIG. 2 is an exploded perspective view of the first embodiment illustrated in FIG. 1.
Figure 3:
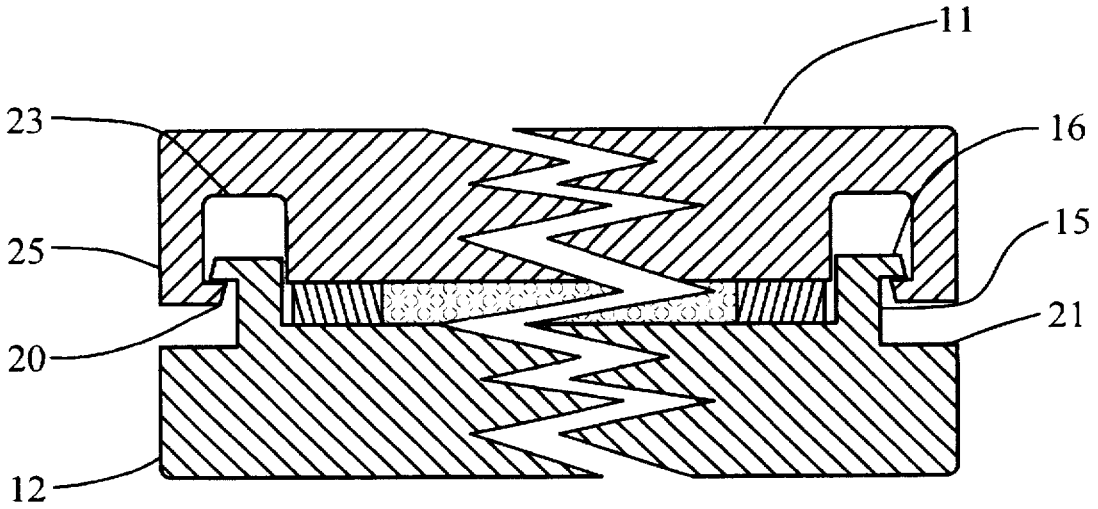
FIG. 3 is a fragmentary sectional view taken along the line 3—3 of FIG. 2.

The present invention is a street hockey puck designed for play on rough surfaces. Seven embodiments are presented in the following description. All of the embodiments consist of two, generally equal sized, disks that are connected to each other. The disks are not tightly connected together. The connectors allow them to move relative to each other. In six of the seven embodiments, energy absorbing material or parts are sandwiched between the two disks. A perspective view of the first embodiment 10 is illustrated in FIG. 1. The first embodiment is made up of a female disk 11 and a male disk 12. With reference to FIGS. 2 and 3, between the two disks is a foam ring 13. A suitable foam material is polyurethane that can be depressed 25% with a force less than one pound per square inch. The foam ring 13 is located within a cavity 14 formed by the circular wall 15. This wall 15 is part of the male disk half 12. Attached to the wall is a beveled external circular catch 16.

Within the female disk 11, directly opposite the external circular catch 16 is a circular channel 23. At the mouth of this channel 23, extending from the outside wall 25, is a beveled internal catch 20. During assembly of the puck the axes of the two disks are aligned and the disks are pushed together. The beveled external catch 16 presses against the beveled internal catch 20. This causes the outside wall 25 to flex and the two catches to slide past each other. At that point the wall returns to its relaxed position and the two disks are locked together. As seen in FIG. 3 the foam ring 13 keeps the two disks from completely coming together. The channel 23 is sufficiently deep so that the circular wall 15 does not strike the female disk 11 when the disk collapses. Likewise the shoulder 21 in the male disk 12 prevents the outside wall 25 from striking the male disk 12.

Figure 4:
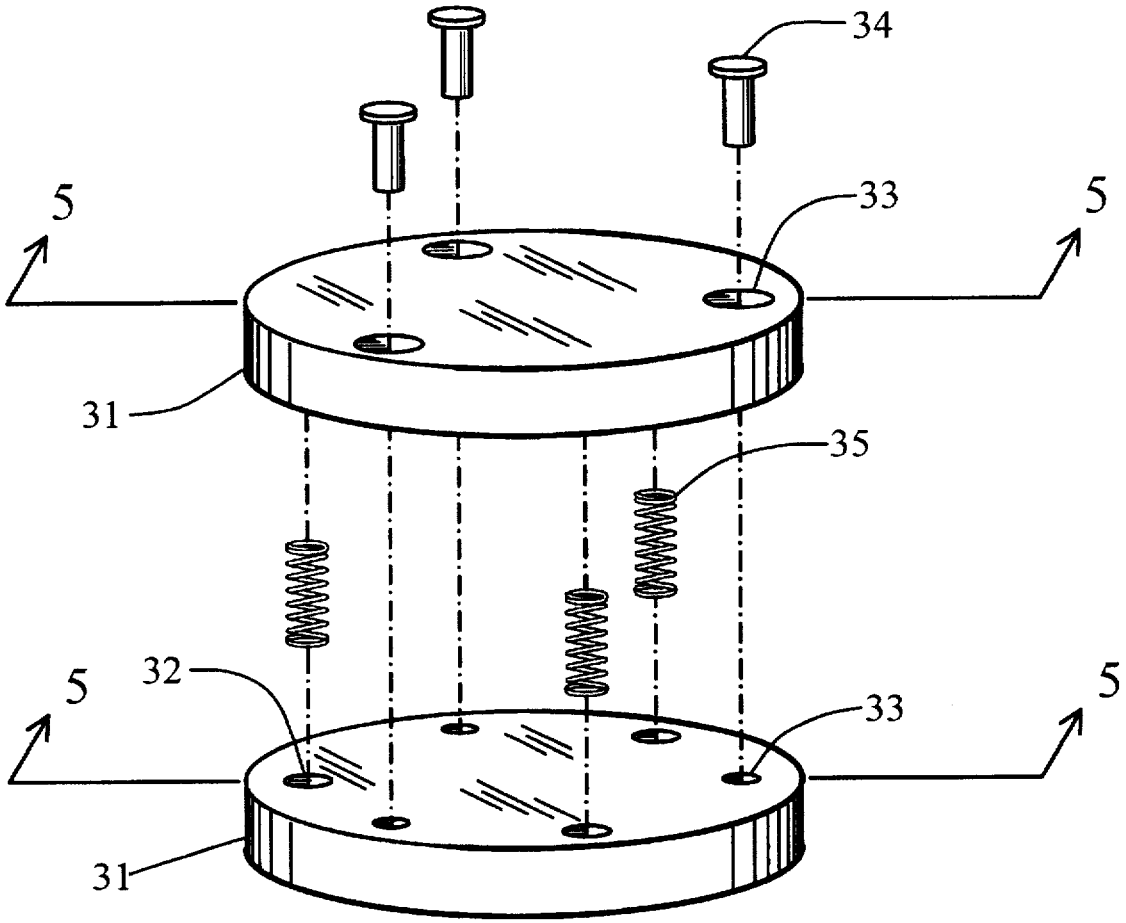
FIG. 4 is an exploded perspective view of the second embodiment.
Figure 5:
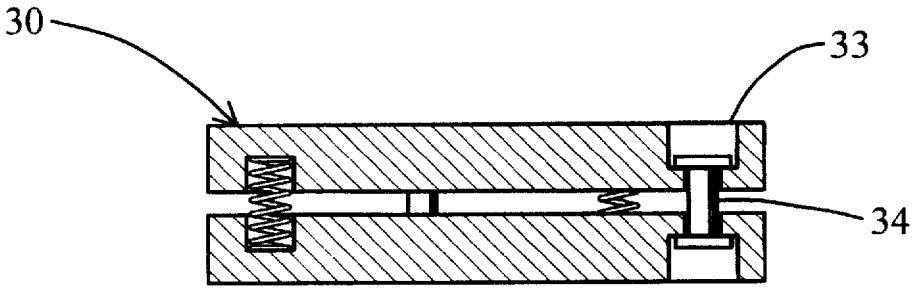
FIG. 5 is a sectional view taken along the line 5—5 of FIG. 4.

The disks in the second embodiment 30 are neither male or female. As shown in the exploded perspective view in FIG. 4, the two disks 31 in this embodiment are identical. These disks 31 are cylinders with six holes in them. Three of the holes 33 are counter sunk through holes and the other three are blind holes 32. Three springs 35 are captured and held within the blind holes 32. Semi-tubular rivets 34 are inserted into the counter sunk through holes 33. These rivets are crimped and hold the puck together as shown in FIG. 5. FIG. 5 is a cross sectional view of the assembled second embodiment 30. As can be seen in FIG. 5 after the puck has been assembled the two disks are not in direct contact. The springs 35 keep the two disks apart. The spring constant of these springs is relatively light and the disks can be pushed together with only about five ounces of force.

Figure 6:
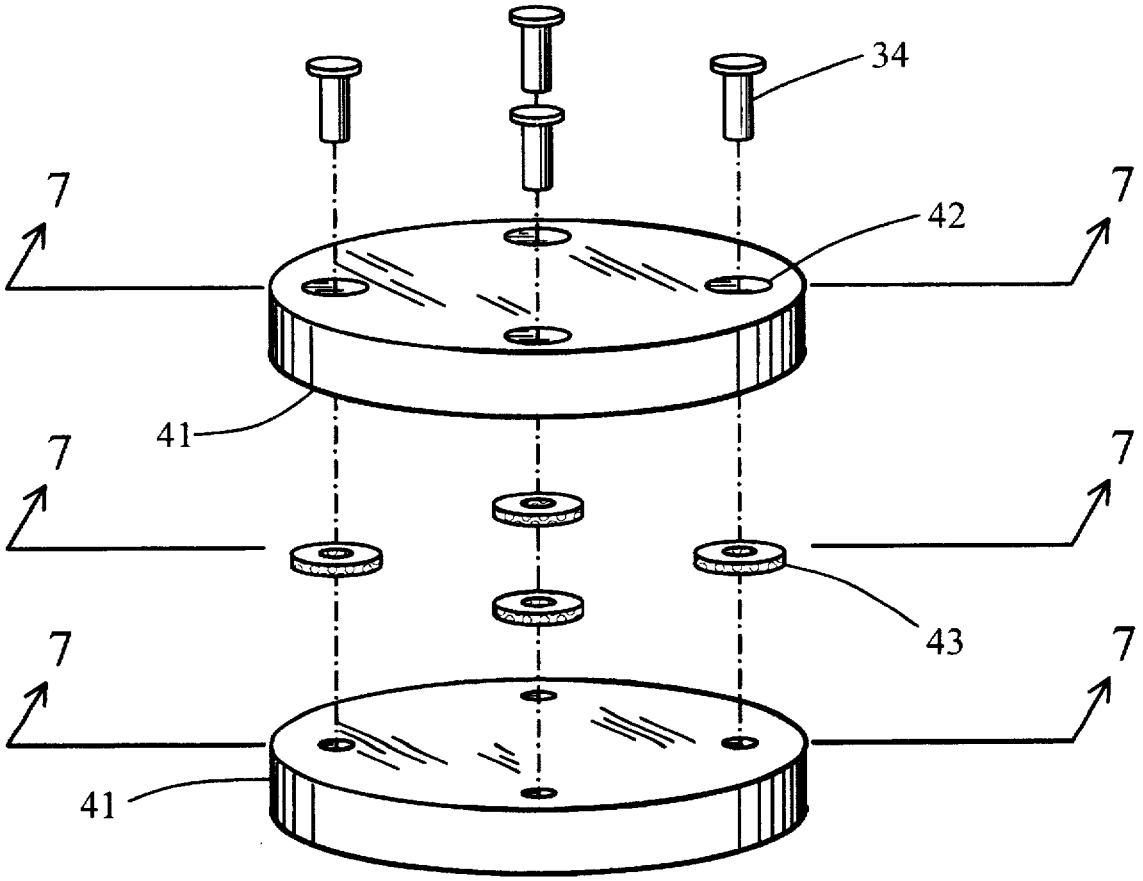
FIG. 6 is an exploded perspective view of the third embodiment.
Figure 7:
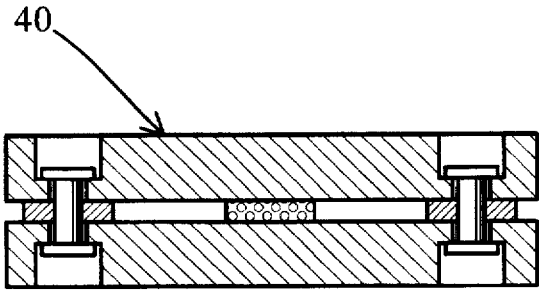
FIG. 7 is a sectional view taken along the line 7—7 of FIG. 6.

The third embodiment 40 is shown in FIGS. 6 and 7. In place of springs, small foam washers 43 are used to separate the disks 41. The force required to depress this foam is very light. A force of less than one pound per square inch will compress the foam 25%. One suitable foam material for the washers is polyurethane. The two disks 41 in the third embodiment are identical. They are connected together with four semi-tubular rivets 34. The rivets are mounted in the counter sunk holes 42.

Figure 8:
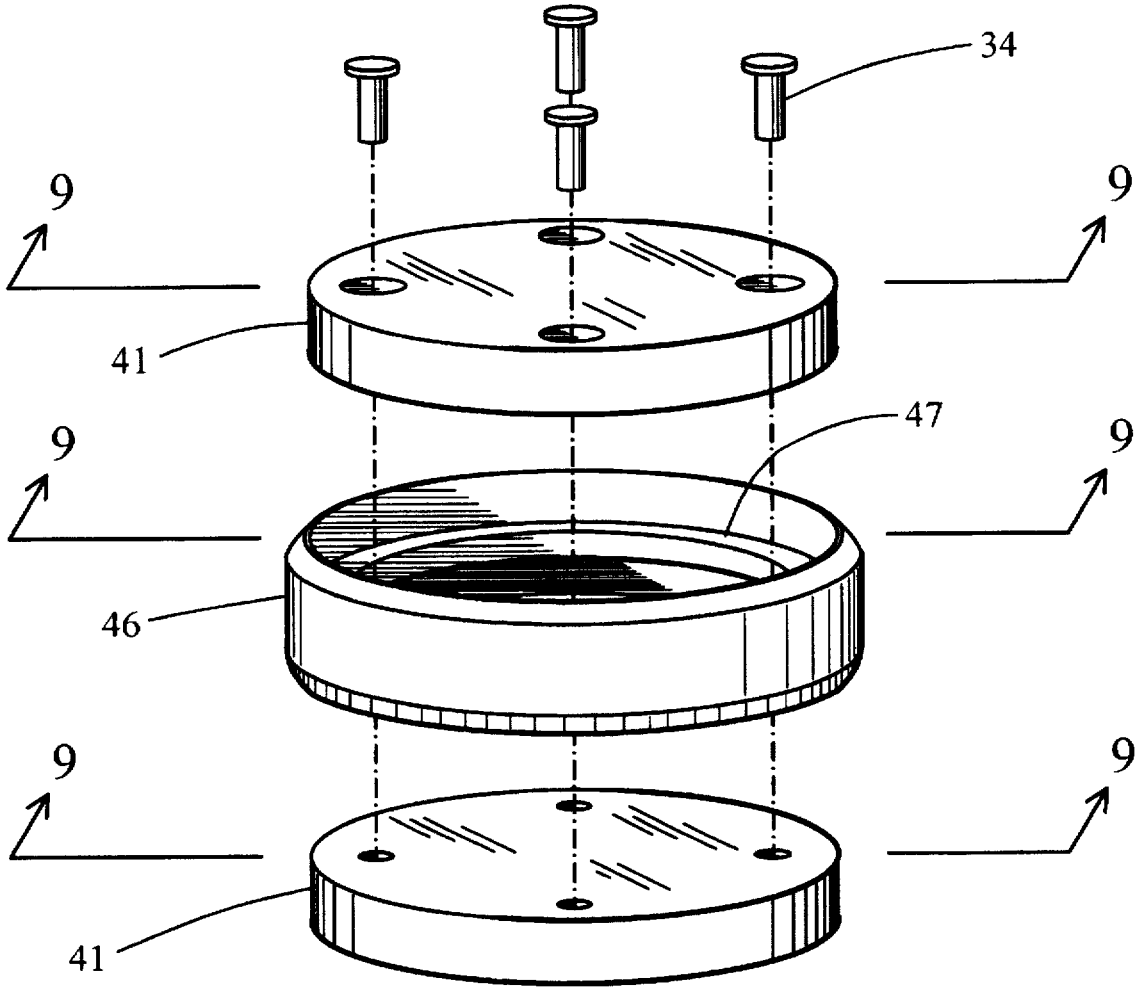
FIG. 8 is an exploded perspective view of the fourth embodiment.
Figure 9:
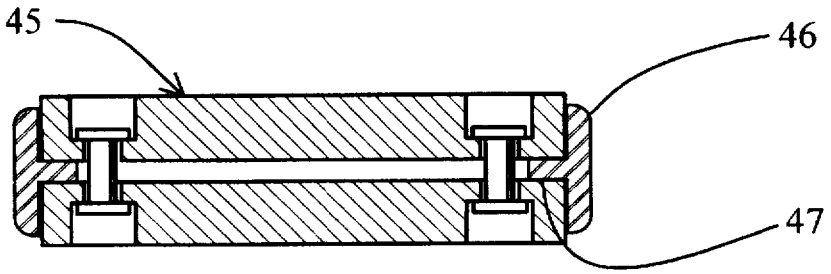
FIG. 9 is a sectional view taken along the line 9—9 of FIG. 8.

The fourth embodiment 45 is shown is FIGS. 8 and 9. The fourth embodiment is identical to the third embodiment with the exception of the foam separating the disks. The foam in the fourth embodiment is a beveled ring 46 with an internal flange 47. The flange 47 separates the two disks 41. As can be seen in FIG. 9, when the puck is assembled the foam ring 46 covers most of the outside circumference of the puck.

Figure 10:
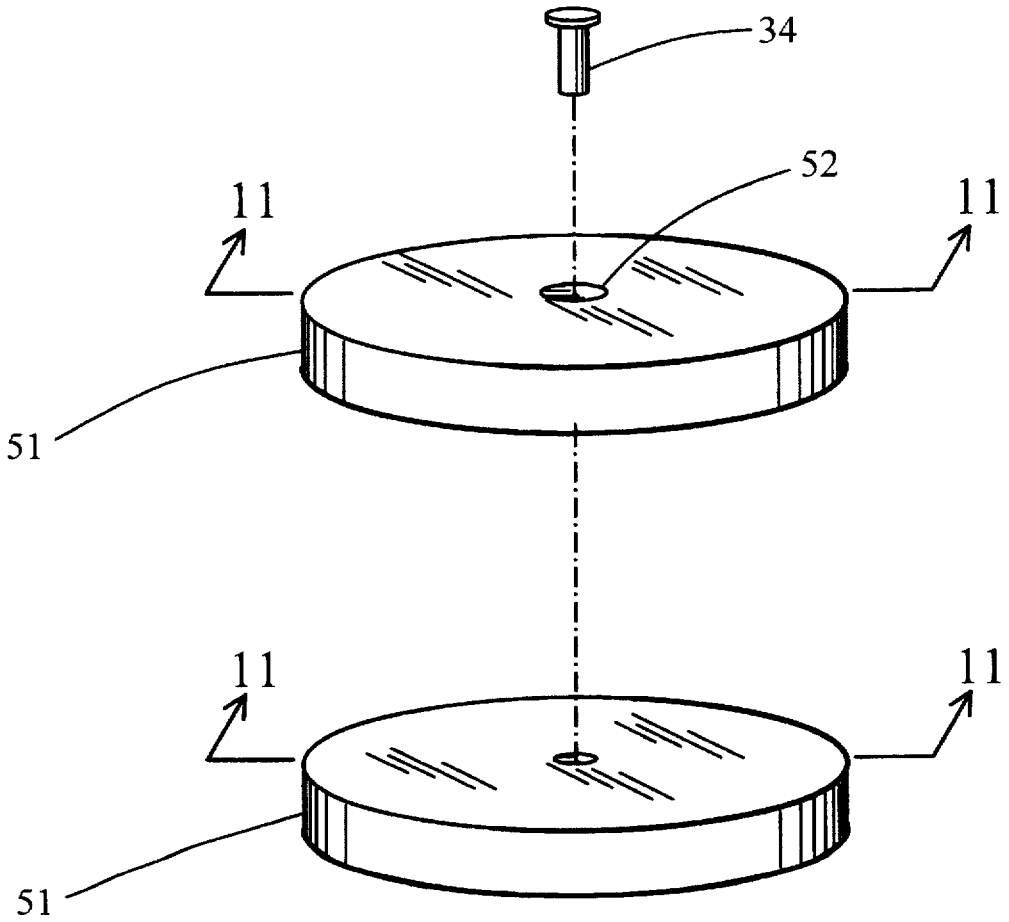
FIG. 10 is an exploded perspective view of the fifth embodiment.
Figure 11:
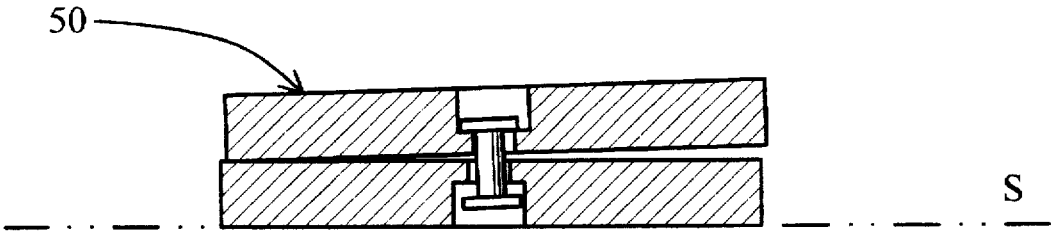
FIG. 11 is a sectional view taken along the line 11—11 of FIG. 10.

The fifth embodiment 50 is shown in FIGS. 10 an 11. The two disks 51 of this embodiment are also identical. They are connected by one rivet 34 in the counter sunk hole 52. As seen in FIG. 11 this hole is slightly oversized. There are no springs or foam separating the two disks 51 in this embodiment. I theorize that it is the loose connection between the two disks that allows them to successfully slide across rough surfaces without upsetting. As illustrated in FIG. 11, as they slide across a surface S they just rattle along over the imperfections.

Figure 12:
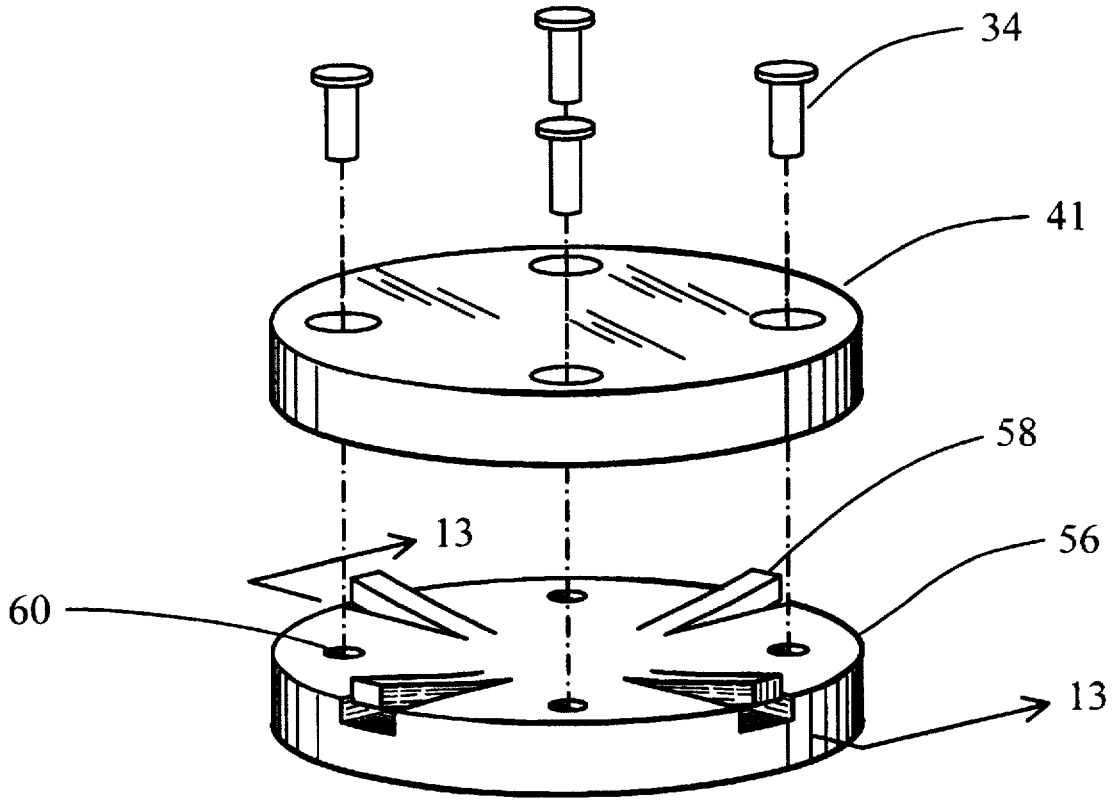
FIG. 12 is an exploded perspective view of the sixth embodiment.
Figure 13:
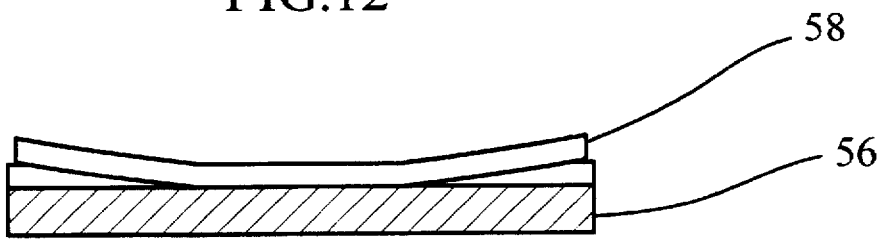
FIG. 13 is a sectional view taken along the line 13—13 of FIG. 12.
Figure 14:
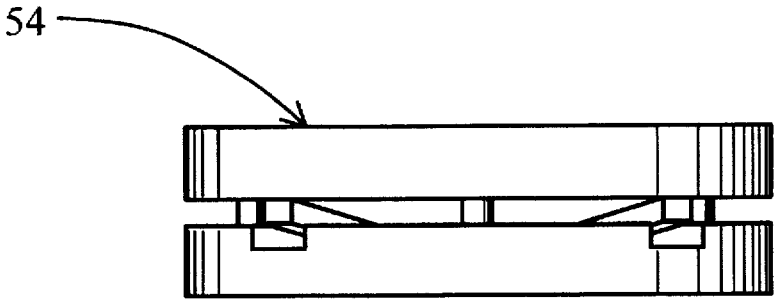
FIG. 14 is a side elevational view of the puck illustrated in FIG. 12.
Figure 17:
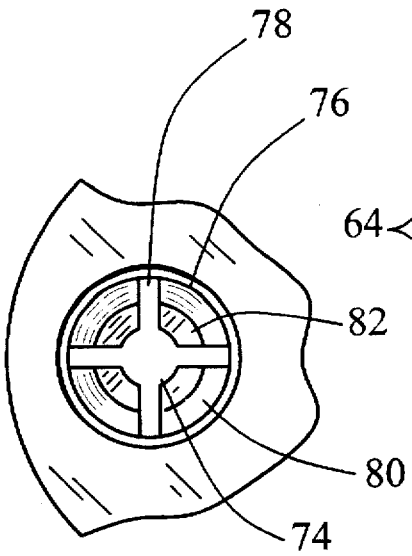
FIG. 17 is a detailed fragmentary view of the female connector.
Figure 15:
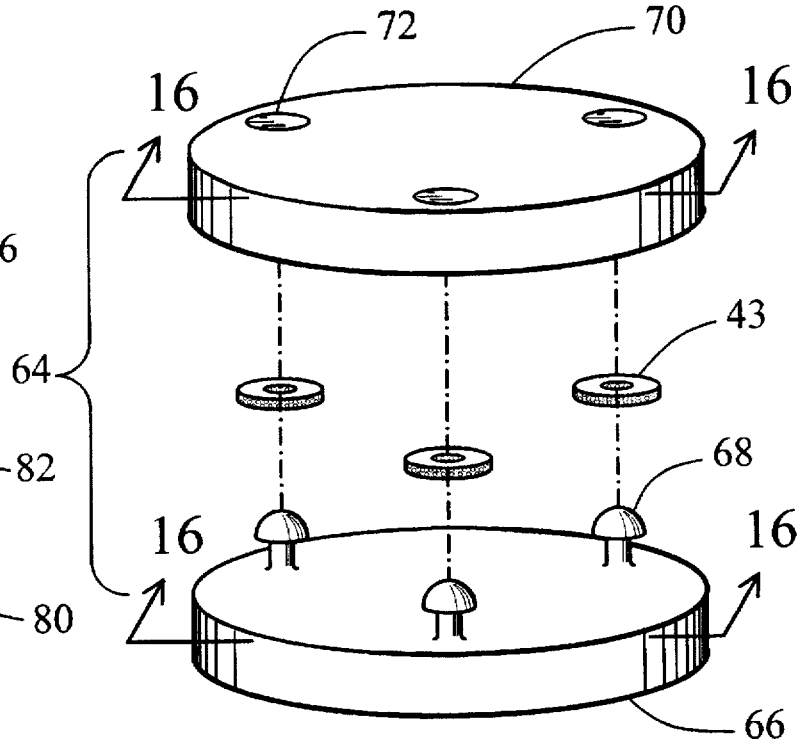
FIG. 15 is an exploded perspective view of the seventh embodiment.

The disks of all of the puck embodiments could be made with injection molded plastic such as high density polyethylene (HDPE). By proper design, the injection molded disks could also incorporate the other parts of the puck. The sixth embodiment 54, illustrated in FIGS. 12, 13, and 14, discloses one method of incorporating springs into one of the puck disks. The disk 56 has four channels 59 on its inner surface. The channels radiate out from the axis of the disk. Within each channel is a flexible cantilever arm 58. The cantilever arms 58 are attached to the main body of the disk at the centermost end of each channel 59. From there the cantilever arms radiate outward from the axis. As they radiate outward they also bend away from their respective channels. Thus when the puck is assembled, FIG. 14, the flexible cantilever arms serve as springs between the two disks 41 and 56.

Figure 16A:
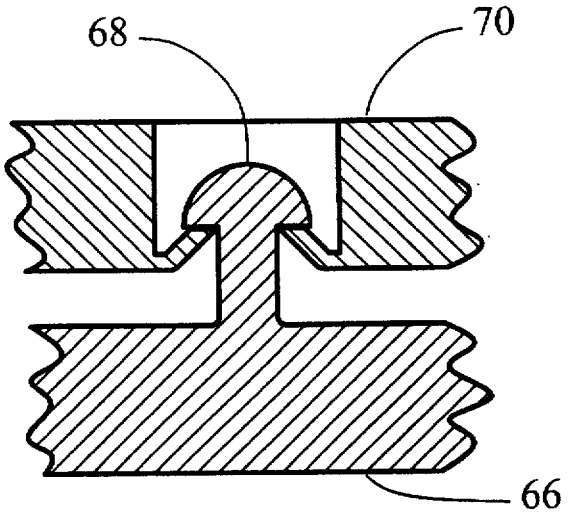
FIG. 16*a* is a fragmentary sectional view taken along the line 16—16 showing the relative positions of the connectors when the foam washers not compressed.
Figure 16B:
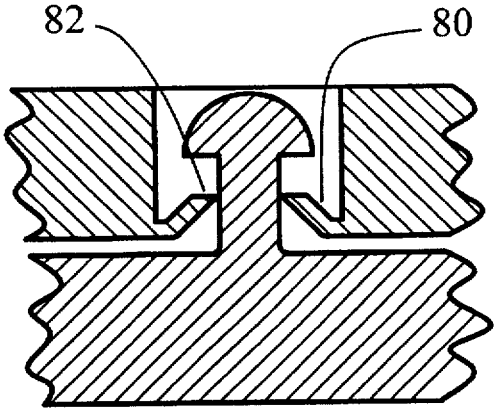
FIG. 16*b* is a fragmentary sectional view taken along the line 16—16 showing the relative positions of the connectors when the foam washers are compressed.

The second part that could be incorporated into an injection molded puck disk is the connector. Called snap joint assemblies, they are very commonly used to assemble injection molded parts. The first embodiment 10 used an inseparable annular snap joint assembly. Another snap assembly is used in the seventh embodiment, shown in FIGS. 15, 16*a*, 16*b*, and 17. The seventh embodiment uses a modified ball and socket snap fit assembly. Instead of a complete ball, a half ball 68 is used for assembly of this puck. Three of these 68 are attached to the disk 66. Within disk 70 are three corresponding sockets 72 for receiving the half balls 68. Within the socket 72 are four cantilever beams 76 arranged around a circular opening 74. The beams are separated by a slit 78 and the circular opening 74. The beams are attached near the inner end of the cylindrical disk 70 and extend 80 toward the outer end of the cylindrical disk. The half ball 68 rests against the flat end 82 of the beam when the two disks are fully separated, the condition shown in FIG. 16*a*. FIG. 16*b* shows the snap assembly parts when the two disks are only partially separated, which can occur when the puck is traveling over a rough surface. For purposes of clarity the foam washer 43 was not shown in FIGS. 16*a* and 16*b*.

OPERATION

The flat contact surface of this puck allows it to slide over many of the imperfections in the surfaces on which it is used. With imperfections that do effect its travel, the effect is lessened by the two piece design. With this design only half of the puck ever makes direct contact with an imperfection. This results in the puck only receiving half of the possible deflecting energy caused by the imperfection. When the spring or foam compresses and expands, it further dissipates some of this deflecting energy before it is transmitted to the other half of the puck. So imperfections probably deliver less than half as much deflecting energy to this puck compared to a puck of solid design.

Some imperfections will cause the puck to lift off of the playing surface. When this happens the benefit of this design again comes into effect. When the lifted puck lands back on the surface the bottom half makes first contact. It hits the ground with only half of the pucks energy. The energy of the bottom half's rebound from the surface will be about half of what it would be if the puck was solid. As the bottom is moving up the top is still moving down. Together they compress the spring or foam which dissipates some of their energy. Additionally, the effect of the top moving down cancels much of the energy in upward moving bottom, effectively neutralizing the deflecting forces. The effect of the two halves often moving in opposite directions, may be the primary factor in the puck's outstanding performance on rough surfaces. The fifth embodiment does not have energy absorbing foam or springs yet it performs at least half as well at the embodiments that do have foam or springs.

In comparison, solid pucks perform many times worse on these same rough surfaces. This suggests that the bouncing and tumbling of these solid pucks is not a result of the first imperfection they hit. Instead, it suggest that the violence of each contact with the rough surface multiplies. After a few of these increasingly violent surface contacts the solid puck is tumbling, bouncing, or rolling on its edge.

SUMMARY, RAMIFICATIONS, AND SCOPE

There is no ideal street puck that fits every situation. The character of the street hockey playing surfaces vary from smooth to rough. Also, the needs of players can vary. Some ice hockey players may want a heavily weighted street puck to practice their shooting. Such a puck would be too heavy to use in a game. Price and performance requirements also vary. The highest performing puck would usually not be needed in a kids' neighborhood game. They would more likely be interested in a good puck at a lower price. The serious ice hockey player will want to use a puck that performs as close as possible to the performance of ice hockey pucks on ice. Practice time on ice is limited and expensive. A higher cost, high performance, street hockey puck would probably save them money.

There is a range of cost and performance with the different embodiments of the present invention. The characteristics of each embodiment can also be tailored by changes in the pucks weight and the compressibility constant of the foam or springs. The number of connectors and springs or foam washers is not limited by the embodiments shown. For example, the second embodiment shows a puck with three individual springs, but a puck can also be made with one or four springs. The number of connectors used can also be varied from one, three or four. Two connectors or springs would probably not be desireable and more than four would probably offer no measurable benefit. The puck disks can be made from several different plastics including acetal, nylon, and high density polyethylene. The choice of plastic will effect the pucks weight, duability, performance, and cost.

While the present embodiments of this invention have been described, it should be understood that various changes, adaptations and modifications may be made therein without departing from the spirit of the invention and the scope of the appended claims. Thus the scope of the invention should be determined by the appended claims and their legal equivalents, rather than by the examples given.

I claim:

1. A hockey puck for play on non-ice surfaces comprising:

(a) a first cylindrical member having first and second generally parallel ends;

(b) a second cylindrical member having first and second generally parallel ends and with a diameter generally equal to said first cylindrical member;

(c) a connective means for loosely joining said first and second cylindrical members so that their respective ends are generally parallel and that their respective axes are substantially coincident when said puck is at rest.

2. A hockey puck as in claim 1 wherein said connective means allows said first cylindrical member to move relative to said second cylindrical member a predetermined distance whereby reducing the likelihood of said hockey puck to bounce or tumble as it travels across said non-ice surface.

3. A hockey puck as in claim 1 wherein said connective means allows the angle between the axis of said first cylindrical member and the ends of said second cylindrical member to vary a predetermined number of degrees, whereby reducing the likelihood of said hockey puck to bounce or tumble as it travels across said non-ice surface.

4. A hockey puck as in claim 1 wherein said connective means allows the axis of said first cylindrical member to move at right angles to the axis of said second cylindrical member a predetermined distance, whereby reducing the likelihood of said hockey puck to bounce or tumble as it travels across said non-ice surface.

5. A hockey puck as in claim 1 further including an energy absorbing means sandwiched between said first and second cylindrical members.

6. A hockey puck as in claim 5 wherein said energy absorbing means is one or more springs.

7. A hockey puck as in claim 5 wherein said energy absorbing means is one or more foam members.

8. A hockey puck as in claim 5 wherein said energy absorbing means is molded into one or both of said cylindrical members.

9. A hockey puck as in claim 1 wherein said connective means includes one or more through holes in each said cylindrical member and a rivet in each corresponding pair of said holes.

10. A hockey puck as in claim 1 wherein said connective means includes a screw.

11. A hockey puck as in claim 1 wherein said connective means is molded into said cylindrical members.

12. A hockey puck for play on non-ice surfaces comprising:

(a) a first cylindrical member having first and second generally parallel ends;

(b) a second cylindrical member having first and second generally parallel ends and with a diameter generally equal to said first cylindrical member;

(c) one or more counter-sunk through holes in each of said cylindrical members through which rivets loosely join said cylindrical members so that their respective ends are generally parallel and that their respective axes are substantially conincident when said puck is at rest;

(d) one or more energy absorbing foam members sandwiched between said cylindrical members whereby the shock of striking imperfections in the playing surface is dampened in order to reduce the likelihood of said puck to bounce or tumble.

13. A hockey puck for play on non-ice surfaces comprising:

(a) a first cylindrical member having first and second generally parallel ends;

(b) a second cylindrical member having first and second generally parallel ends and with a diameter generally equal to said first cylindrical member;

(c) a connective means molded into said first and second cylindrical members for loosely joining said members so that there respective ends are generally parallel and that their respective axes are substantially adjacent when said puck is at rest;

(d) an energy absorbing means molded into one or both of said cylindrical members and said energy absorbing means located between said cylindrical members.

14. A hockey puck of claim 13 wherein the connective means is an inseparable snap joint.

15. A hockey puck of claim 13 wherein the energy absorbing means is a cantilever arm.

* * * * *